US009696668B2

(12) United States Patent
Yamaguchi et al.

(10) Patent No.: US 9,696,668 B2
(45) Date of Patent: Jul. 4, 2017

(54) FIXING DEVICE AND IMAGE FORMING APPARATUS

(71) Applicants: Yoshiki Yamaguchi, Kanagawa (JP); Yoshio Hattori, Kanagawa (JP); Ryuuichi Mimbu, Kanagawa (JP); Haruyuki Honda, Kanagawa (JP); Toshihiko Shimokawa, Kanagawa (JP)

(72) Inventors: Yoshiki Yamaguchi, Kanagawa (JP); Yoshio Hattori, Kanagawa (JP); Ryuuichi Mimbu, Kanagawa (JP); Haruyuki Honda, Kanagawa (JP); Toshihiko Shimokawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/063,578

(22) Filed: Mar. 8, 2016

(65) Prior Publication Data

US 2016/0274513 A1 Sep. 22, 2016

(30) Foreign Application Priority Data

Mar. 19, 2015 (JP) ..... 2015-056778

(51) Int. Cl.
*G03G 15/00* (2006.01)
*G03G 15/20* (2006.01)

(52) U.S. Cl.
CPC ..... *G03G 15/2053* (2013.01); *G03G 15/2028* (2013.01); *G03G 15/6576* (2013.01); *G03G 2215/2035* (2013.01)

(58) Field of Classification Search
CPC ..... G03G 15/2053; G03G 15/6576; G03G 15/6573; G03G 2215/00662;
(Continued)

(56) References Cited

U.S. PATENT DOCUMENTS 6,064,853 A * 5/2000 Embry ..... G03G 15/6576 399/406
7,298,981 B2 * 11/2007 Oohara ..... G03G 15/2028 399/406
(Continued)

FOREIGN PATENT DOCUMENTS

JP 4-044075 2/1992
JP 7-089660 4/1995
(Continued)

*Primary Examiner* — Sophia S Chen
(74) *Attorney, Agent, or Firm* — Harness, Dickey & Pierce, PLC

(57) ABSTRACT

A fixing device includes a fixing member; a heater to heat the fixing member; a nip forming member to contact the fixing member; and a pressure member, disposed opposite the nip forming member to press against the fixing member to form a fixing nip portion together with the nip forming member. The fixing device applies heat and pressure to fix an image transferred to a recording sheet when the recording sheet passes through the fixing nip. The nip forming member includes a first and second planar portions disposed at an upstream end and a downstream end, respectively, of the fixing nip portion, and the first planar portion and the second planar portion are continuous with a curved portion of the nip forming member. A guide member guides the recording sheet to bend in a direction opposite a back curl of the recording sheet generated in the fixing nip portion.

8 Claims, 11 Drawing Sheets

(58) Field of Classification Search
CPC ..... G03G 15/2028; G03G 2215/2035; B65H 2301/51256
USPC ..... 399/329, 406
See application file for complete search history.

(56) References Cited

U.S. PATENT DOCUMENTS

| | | | | |
|---|---|---|---|---|
| 7,369,787 | B2 * | 5/2008 | Otsuka | G03G 15/2039 399/406 |
| 2008/0145124 | A1 * | 6/2008 | Ruiz | G03G 15/6573 399/406 |

FOREIGN PATENT DOCUMENTS

| | | |
|---|---|---|
| JP | 8-262903 | 11/1996 |
| JP | 8-314317 | 11/1996 |
| JP | 2012-091891 | 5/2012 |

* cited by examiner

FIXING DEVICE AND IMAGE FORMING APPARATUS

CROSS-REFERENCE TO RELATED APPLICATION

The present application claims priority pursuant to 35 U.S.C. §119(a) from Japanese patent application number 2015-056778 filed on Mar. 19, 2015, the entire disclosure of which is incorporated by reference herein.

BACKGROUND

Technical Field

The present invention relates to an image forming apparatus employing electrophotography such as a copier, a printer, or a facsimile machine.

Background Art

In an image forming apparatus employing electrophotography, an electrostatic latent image is first formed in an image forming section, the electrostatic latent image is developed by toner as a developer and is rendered visible as a toner image, the developed toner image is transferred to a recording sheet by a transfer device, and subsequently, the image is fixed onto the recording sheet by a fixing device.

The fixing device include a heating member and a pressure roller that press against each other to form a fixing nip portion, through which the recording sheet on which an unfixed toner image is borne passes through. The recording sheet is pressed and heated when passing through the fixing nip, so that the toner image is fixed onto the recording sheet.

One typical fixing device for use in the image forming apparatus employs electrophotography and includes a securing member slidably contacting an inner surface of the rotary member.

Another typical fixing device employs a film heating method including: a pressure roller; an endless fixing film; a ceramic heater; and a fixing nip portion formed by pressing the pressure roller against the ceramic heater with an endless fixing film sandwiched in between. The recording sheet bearing an unfixed toner image is passed through the fixing nip portion, applies heat from the ceramic heater to the recorded material via the fixing film, to thereby press and fix the unfixed toner image onto the recording sheet.

Further another fixing device employs a belt nip method, in which an outer circumference of a running endless belt is closely contacted to the thermal fixing roller including an elastically deformable surface layer as well as the surface layer of the thermal fixing roller is elastically deformed by the pressure pad, to thus form a fixing nip portion, and the recording sheet bearing the unfixed toner image is passed through the fixing nip portion and is fixed.

SUMMARY

In one embodiment of the disclosure, provided is an optimal fixing device including a flexible endless fixing member; a heater to heat the fixing member; a nip forming member to contact the fixing member directly or via a slide member; and a pressure member, disposed opposite the nip forming member via the fixing member, to press against the fixing member to form a fixing nip portion together with the nip forming member and rotationally drive the fixing member, wherein the fixing device applies heat and pressure to fix an image transferred to a recording sheet when the recording sheet passes through the fixing nip portion. The nip forming member includes a first planar portion and a second planar portion disposed at an upstream end and a downstream end, respectively, of the fixing nip portion in a feeding direction of the recording sheet, the second planar portion positions at a side at which the second planar portion is further away from the pressure member by a predetermined size than the first planar portion, and the first planar portion and the second planar portion are continuous with a curved portion of the nip forming member. The fixing device further includes a guide member, disposed downstream of the fixing nip portion in the feeding direction of the recording sheet on the same side as the pressure member relative to a feeding path of the recording sheet, to guide the recording sheet to bend in a direction opposite a direction of a back curl of the recording sheet generated in the fixing nip portion.

In another embodiment of the disclosure, provided is an optimal image forming apparatus including the above optimal fixing device.

These and other objects, features, and advantages of the present invention will become apparent upon consideration of the following description of the preferred embodiments of the present invention when taken in conjunction with the accompanying drawings.

DETAILED DESCRIPTION

However, when fixation of toner is thermally performed, there is a difference in temperature between the heating member and the pressure roller that forms the fixing nip portion. The difference of temperature causes the recording sheet that passes through the fixing nip portion, to have a different temperature between a front side and a back side thereof, that is, a front side of the heating member and a back side of the pressure roller. Specifically, the surface of the recording sheet contacting the heating member shows a higher temperature than the back side of the recording sheet contacting the pressure roller.

As a result, after passing through the fixing nip, more of the moisture contained in the recording sheet evaporates from the front surface of the recording sheet than from the back side, and the moisture moves from the back side to the front side. As a result, moisture in the front side becomes larger than that in the back side and extension of fiber member in the front side increases, so that the recording sheet curls to the back side (which is called a back curl).

Further, when the recording sheet is a two-ply envelope, a side contacting the heating member generates a back curl, there occurs a shift between the paper contacting the heating member and the paper contacting the pressure roller, and due to this, wrinkles are generated. In such a fixing device, when the recording sheet is ejected with a large back curl, the defined number of recording sheets cannot be stacked on a sheet ejection tray, or alternatively, the stacked sheets in the tray are messed up.

First, a general configuration of an image forming apparatus 1 according to an embodiment of the present invention will be described.

Figure 1:
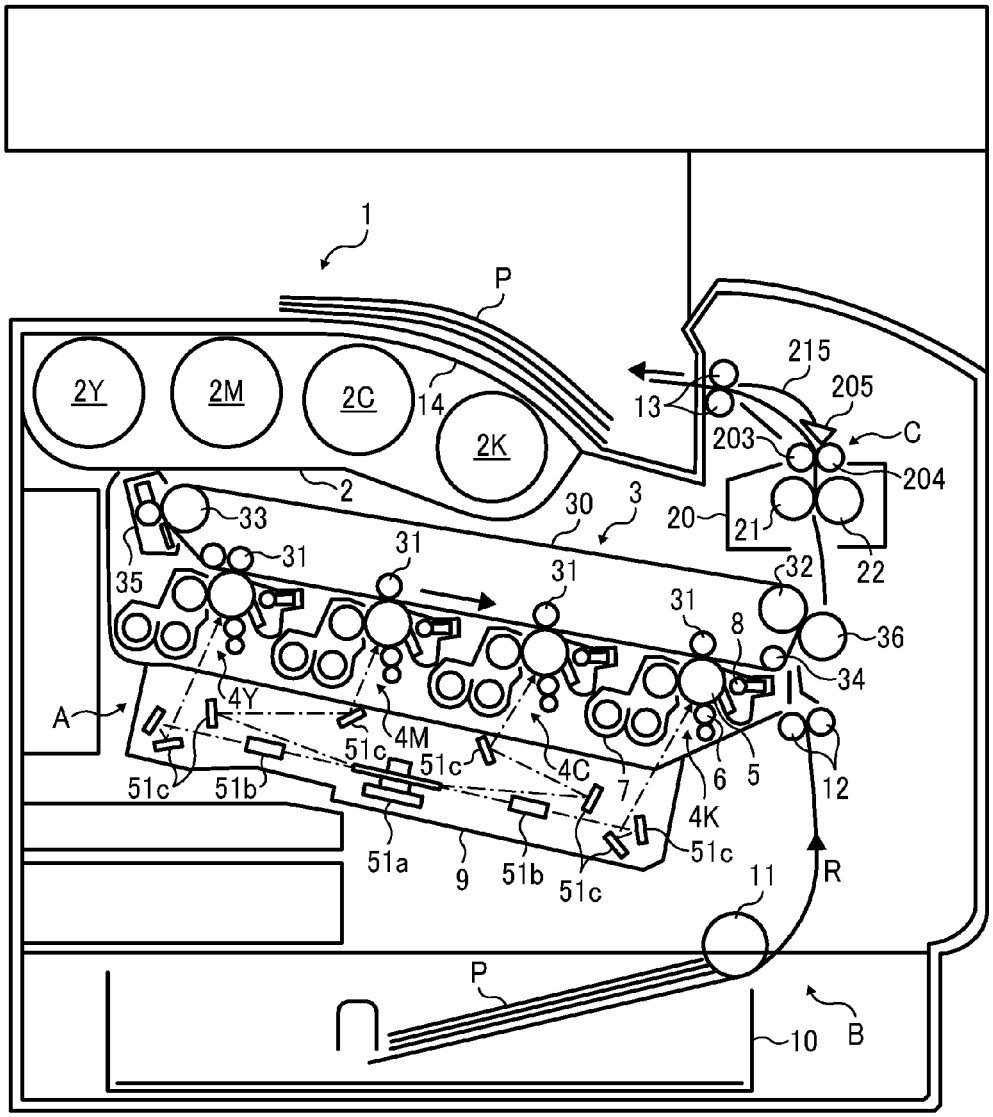
FIG. 1 schematically illustrates a fixing device and an image forming apparatus according to one embodiment of the present invention.

As illustrated in FIG. 1, the image forming apparatus 1 in this embodiment is a color laser printer, and includes an image forming section A, a sheet feed section B, a fixing device 20, a pair of sheet ejection rollers 13, and a sheet ejection tray 14.

The image forming section A includes four image forming units 4Y, 4M, 4C, and 4K, an exposure device 9, and a transfer device 3, all of which will be described later in detail. The fixing device 20 of the present image forming apparatus 1 includes a back curl correction structure C, which will be described in detail.

The image forming apparatus 1 includes four image forming units 4Y, 4M, 4C, and 4K disposed in the center of the apparatus. Each of the image forming units 4Y, 4M, 4C, and 4K has the same structure except that each includes a different color of developer such as yellow (Y), magenta (M), cyan (C), and black (K) that corresponds to RGB color separation component of a color image.

Specifically, each image forming unit 4Y, 4M, 4C, or 4K includes a drum-shaped photoconductor 5 as a latent image bearer; a charger 6 to charge a surface of the photoconductor 5; a developing device 7 to supply toner on the surface of the photoconductor 5; and a cleaning device 8 to clean the surface of the photoconductor 5.

In FIG. 1, only the photoconductor 5, the charger 6, the developing device 7, and the cleaning device 8 that the black image forming unit 4K includes are applied with a reference numeral and reference numerals for other image forming units 4Y, 4M, and 4C are omitted, because all image forming units are similarly constructed.

An exposure device 9 to expose a surface of the photoconductor 5 is disposed underneath the image forming units 4Y, 4M, 4C, and 4K. The exposure device 9 includes a laser light source, a polygonal mirror 51*a*, an fθ lens 51*b*, a plurality of reflection mirrors 51*c*, and the like, and is configured to irradiate each surface of the photoconductor 5 with laser beams based on image data, to thereby form an electrostatic latent image on the surface of the photoconductor 5.

A transfer device 3 is disposed above each of the image forming units 4Y, 4M, 4C, and 4K. The transfer device 3 includes an intermediate transfer belt 30 as an intermediate transfer member; four primary transfer rollers 31 as primary transfer members; a secondary transfer backup roller 32; a cleaning backup roller 33; a tension roller 34; and a belt cleaning device 35.

The intermediate transfer belt 30 is an endless belt stretched around the secondary transfer backup roller 32, the cleaning backup roller 33, and the tension roller 34. When the secondary transfer backup roller 32 rotates, the intermediate transfer belt 30 is driven to rotate in the direction indicated by an arrow in the figure.

The four primary transfer rollers 31 each are disposed at a position opposed to each photoconductor 5 with the intermediate transfer belt 30 sandwiched in between, thereby forming a primary transfer nip. In addition, each primary transfer roller 31 is connected to a power source and a predetermined direct current (DC) voltage or alternating current (AC) voltage is applied to each primary transfer roller 31.

The secondary transfer roller 36 sandwiches the intermediate transfer belt 30 together with the secondary transfer backup roller 32 so as to form a secondary transfer nip. In addition, similarly to the primary transfer rollers 31, the secondary transfer roller 36 is connected to a power source, and a predetermined direct current (DC) voltage or alternating current (AC) voltage is applied to the secondary transfer roller 36.

The belt cleaning device 35 includes a cleaning brush and a cleaning blade which are so disposed as to contact the intermediate transfer belt 30. Waste toner collected by the belt cleaning device 35 is conveyed via a waste toner conveying hose, and is contained in a waste toner container.

A bottle holder 2 is disposed in an upper part of the image forming apparatus. Four toner bottles 2Y, 2M, 2C, and 2K each containing toner for replenishment are detachably mounted to the bottle holder 2. A supply path is disposed between each toner bottle 2Y, 2M, 2C, or 2K and each developing device 7. Toner is supplied to each developing device 7 from a corresponding toner bottle 2Y, 2M, 2C, or 2K.

The sheet feed section B is disposed in the bottom of the image forming apparatus. The sheet feed section B includes a sheet tray 10 in which a recording sheet P as a recording medium is contained, and a sheet feed roller 11 to feed the recording sheet P from the sheet tray 10.

In addition to a regular sheet, recording media include various sheets such as cardboard, a postcard, an envelope, thin paper, coated paper or art paper, tracing paper, an OHP sheet, and the like. A manual sheet feeder may be disposed in the image forming apparatus. In the present embodiment, the cardboard means paper having a basis weight of 160 grams/$m^2$ or more.

Further, a feeding path R through which the recording sheet P is fed from the sheet tray 10 to an outside the apparatus via the secondary transfer nip is disposed inside the image forming apparatus 1. A pair of registration rollers 12 serving as a timing roller to feed the sheet P to the secondary transfer nip at an appropriate timing is disposed upstream in the sheet feeding direction of the secondary transfer roller 36 in the feeding path R.

The fixing device 20 presses and heats the recording sheet P on which an unfixed image is borne and thereby fixes the toner image onto the recording sheet P. The fixing device 20 is disposed downstream in the recording sheet feeding direction than the position of the secondary transfer roller 36. Further, a pair of sheet ejection rollers 13 to eject the recording sheet P outside the body of the apparatus is disposed downstream of the fixing device 20 in the sheet feeding direction of the feeding path R. In addition, a sheet ejection tray 14 to stock the recording sheet P ejected outside the apparatus is disposed on an upper surface of the body of the apparatus.

Further, a back curl correction structure C, which will be described later, is disposed near the fixing device 20 and between the sheet ejection rollers 13 and the fixing device 20.

Next, a basic operation of the image forming apparatus 1 according to an embodiment of the present invention will be described.

When an image forming operation is started, each photoconductor 5 of each of the image forming units 4Y, 4M, 4C, and 4K is driven to rotate clockwise as illustrated in FIG. 1, and each surface of the photoconductor 5 is uniformly charged at a predetermined polarity by the charger 6. An exposure device 9 irradiates laser beams to the charged surface of each photoconductor 5 and an electrostatic latent image is formed on the surface of each photoconductor 5.

In this case, the image data exposed on each photoconductor 5 is monochrome image data decomposed, from the target full-color image, into color data of yellow, magenta, cyan, and black. Each developing device 7 supplies toner to the electrostatic latent image formed on the photoconductor 5, and the electrostatic latent image is rendered visible as a toner image.

When the image forming operation is started, the secondary transfer backup roller 32 rotates counterclockwise and the intermediate transfer belt 30 is driven to rotate in the direction indicated by an arrow in the figure. In addition, because the constant voltage or the constant-current controlled voltage with a polarity opposite that of the toner is applied to each of the primary transfer rollers 31, a transfer electric field is formed in the primary transfer nip between each of the primary transfer rollers 31 and each photoconductor 5.

Thereafter, upon the toner image of each color formed on the photoconductor 5 reaching the primary transfer nip along with the rotation of each photoconductor 5, the toner image of each color formed on each photoconductor 5 is sequentially transferred in a superposed manner on the intermediate transfer belt 30 by the transfer electric field formed in the primary transfer nip.

Thus, a full-color toner image is borne on the surface of the intermediate transfer belt 30. In addition, the residual toner which has not been transferred to the intermediate transfer belt 30 and is remaining on each photoconductor 5 is removed by the cleaning device 8. Thereafter, the surface of each photoconductor 5 is neutralized by a discharger, and the surface potential is initialized.

The sheet feed roller 11 disposed in the bottom of the image forming apparatus is started to rotate so that the recording sheet P is fed out from the sheet tray 10 to the feeding path R. The recording sheet P fed out to the feeding path R is once stopped by the registration rollers 12.

Then, the registration rollers 12 start to rotate at a predetermined timing and feed the recording sheet P to the secondary transfer nip at a timing matched with which the image on the intermediate transfer belt 30 arrives at the secondary transfer nip. In this case, because the transfer voltage having a polarity opposite that of the charged toner of the toner image on the intermediate transfer belt 30 is applied to the secondary transfer roller 36, a transfer electric field is formed at the secondary transfer nip.

Through the electric transfer field, the toner images on the intermediate transfer belt 30 are transferred en bloc to the recording sheet P. In addition, the residual toner, that has not been transferred to the recording sheet P and remaining on the intermediate transfer belt 30 is removed by the belt cleaning device 35 and is conveyed to and collected in a waste toner container.

Thereafter, the recording sheet P is fed to the fixing device 20 and the toner image on the recording sheet P is fixed by the fixing device 19 onto the recording sheet P. Thus, the recording sheet P fed from the fixing device 20 is discharged to the sheet ejection tray 14 outside the body of the apparatus, after passing through the back curl correction structure C.

The description heretofore relates to an image forming operation when a full-color image is formed on the recording sheet P; however, a monochrome image may be formed using any one of the four image forming units 4Y, 4M, 4C, and 4K and an image formed of two or three colors may be possible by using two or three image forming units.

Next, the fixing device 20 including the back curl correction structure C of the image forming apparatus 1 will be described in detail.

Figure 2:
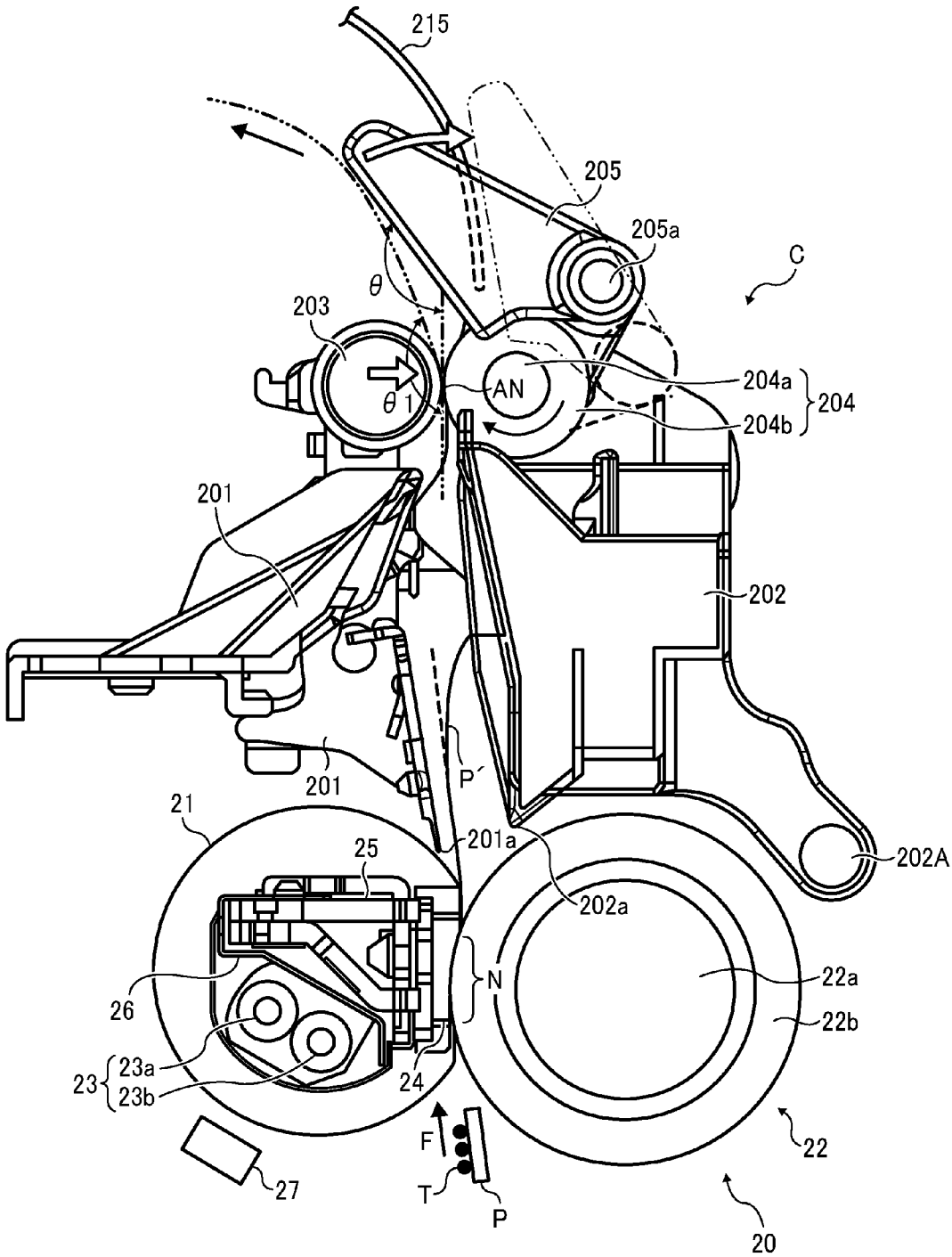
FIG. 2 schematically illustrates the fixing device in correcting a back curl according to one embodiment of the present invention.

FIG. 2 is a cross-sectional view of the fixing device including a back curl correction structure according to the embodiment of the present invention. As illustrated in FIG. 2, the fixing device 20 is used to fuse and fix a toner image T onto the recording sheet P with heat and pressure. The fixing device 20 includes a flexible, endless fixing belt 21 that endlessly moves while being heated.

As illustrated in FIG. 2, the fixing device 20 passes the recording sheet P on which the toner image is transferred in the image forming section A through the fixing nip portion N and fixes the toner image onto the recording sheet P with heat and pressure in the fixing nip portion N.

The fixing device 20 includes a pressure roller 22 in addition to the endless fixing belt 21 serving as a fixing member. The pressure roller 22, serving as a pressure member, is rotatably disposed opposite the fixing belt 21 and forms the fixing nip portion N applying pressure to the fixing belt 21 while contacting it. A heater or a heat source 23 including a plurality of halogen lamps 23*a* and 23*b* is disposed inside the fixing belt 21 and heats an interior side of the fixing belt 21 excluding a position of the fixing nip portion N.

Inside the fixing belt 21 are disposed a nip forming member 24, a base member disposed inside the fixing belt 21, a stay 25 to support the nip forming member 24, a reflecting member 26 to reflect light irradiated from the heater 23 to the fixing belt 21.

Figure 3:
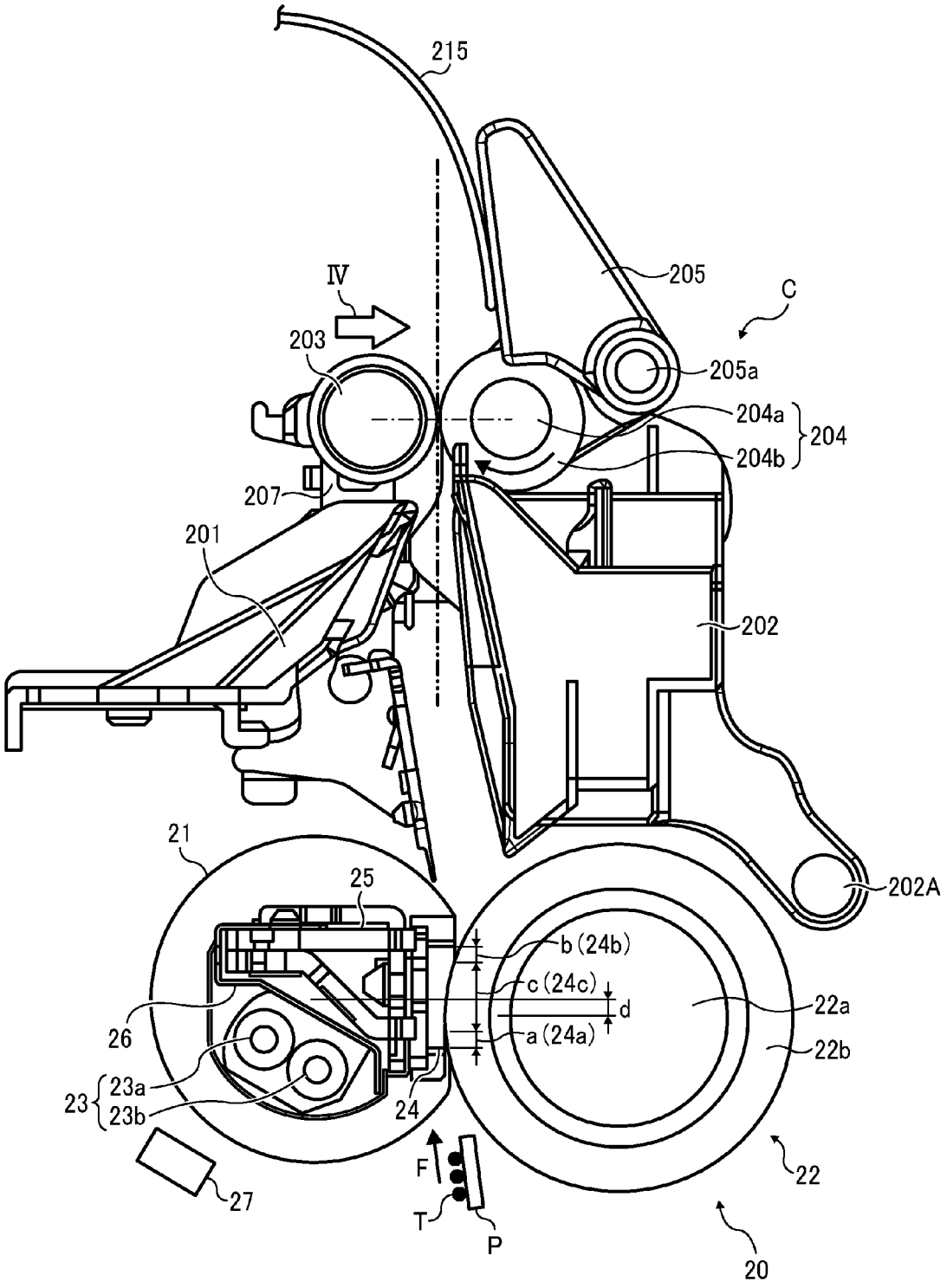
FIG. 3 schematically illustrates the fixing device when a back curl correction is not applied, according to one embodiment of the present invention.

As illustrated in FIG. 3, the nip forming member 24 serving as a base member for forming a nip includes a first planar portion 24*a* that corresponds to an upstream end of the fixing nip portion N formed in a range indicated by a size a in FIG. 3, and a second planar portion 24*b* that corresponds to a downstream end of the fixing nip portion N formed in a range indicated by a size b in FIG. 3, both relative to a plane perpendicular to a line connecting the rotary center of the pressure roller 22 and the center of the fixing nip portion N in the feeding direction. Then, the second planar portion 24*b* conies nearer to the pressure roller 22 by a predetermined amount than the upstream first planar portion 24*a* does. Then, the nip forming member 24 further includes a curved portion 24*c* corresponding to a range indicated by a size c in FIG. 3, that connects the first planar portion 24*a* and the second planar portion 24*b* smoothly. The curved portion 24*c* having a curvature radius substantially equal to that of the outer diameter of the pressure roller 22 connects smoothly the first planar portion 24*a* and the second planar portion 24*b*. A downstream portion of the curved portion 24*c* in the feeding direction has a small curvature radius and connects to the second planar portion 24*b*. A size d in FIG. 3 illustrates a shift amount in the recording sheet feeding direction between the center of the nip forming member 24 in the feeding direction and the rotary center of the pressure roller 22. A sliding member or a low-friction sliding sheet can be wound around the base pad, and the nip forming member 24 contacts the fixing belt 21 directly or via the low-friction sliding sheet.

The nip forming member 24 has a curved shape formed of the curved portion 24*c* shifted in the depth direction of the nip forming member 24 and smoothly connecting the first planar portion 24*a* and the second planar portion 24*b*, thereby improving a feeding property when the recording sheet P is an envelope.

Specifically, when the shape of the fixing nip portion N is a concave cylinder surface or planar surface, one side of the envelope as a recording sheet P adhering to the pressure roller 22 that drives to rotate, when the envelope is passing through the fixing nip portion N, is shifted to a forwarding direction than another surface adhering to the fixing belt 21 that is driven to rotate, to thereby generate wrinkles.

From a repeated envelope printing operation, it was found that, when the shape of the nip forming member 24 constructing the fixing nip portion N is a curved shape including the first planar portion 24*a*, the second planar portion 24*b*, and the curved portion 24*c*, the envelope passes through the fixing nip portion N without shifting, thereby preventing wrinkles from occurring, because one side of the envelope closely attaching to the pressure roller 22 and another side closely attaching to the fixing belt 21 form a curve reverse to the curved shape to cause a back curl to be generated.

The temperature of the fixing belt 21 is detected by a temperature sensor 27 disposed on a side where the recording sheet P enters the fixing nip portion, and is used for feedback process control of the heater 23. In FIG. 2, an arrow F shows a direction along which the recording sheet P is fed.

The fixing belt 21 is an endless belt constructed in a thin sleeve shape with flexibility, and includes a base material and a release layer disposed on a surface of the base material. Examples of the base materials include metallic materials such as nickel or A-SUS or resin materials such as polyimide. Examples of materials for the release layer having a releasability relative to the toner include copolymer of tetrafluoroethylene-perfluoroalkyl vinylether (PFA) or poi ytetrafluoroethylene (PTFE).

The pressure roller 22 disposed opposite the nip forming member 24 with fixing belt 21 sandwiched in between, presses against the fixing belt 21 together with the nip forming member 24, to thereby form a fixing nip portion N.

The pressure roller 22 includes a metal core 22*a;* an elastic layer 22*b* disposed on a circumferential surface of the metal core 22*a*, formed of foamed silicon nibber, silicon rubber, or fluoro-rubber; and a release layer disposed on the surface of the elastic layer 22*b* and formed of PFA or PTFE. The pressure roller 22 is pressed against the fixing belt 21 by a pressure member, and is contacted to the nip forming member 24 as a base member via the fixing belt 21.

The elastic layer 22*b* of the pressure roller 22 is squeezed at a portion where the pressure roller 22 and the fixing belt 21 contact each other, so that the nip forming member 24 secures to have the fixing nip portion N with a predetermined width due to the pressure between the fixing belt 21 and the pressure roller 22.

The pressure roller 22 is configured to rotate by a driving source such as a motor disposed in the printer body. Further, when the pressure roller 22 is driven to rotate, the driving force of the pressure roller 22 is transmitted to the fixing belt 21 at the fixing nip portion N, so that the fixing belt 21 is driven to rotate.

In the fixing device 20 according to the present embodiment, the pressure roller 22 is configured as a solid-core roller, but may be a hollow roller. When the pressure roller 122 is a hollow roller, a heat source such as a halogen heater using radiation heat may be disposed inside the pressure roller 22. If the pressure roller 22 does not include an elastic layer 22*b*, a thermal capacity of the pressure roller 22 is reduced and the fixing property is improved. However, when the unfixed toner is pressed and fixed, minute concavity and convexity of the belt surface is transferred to the image and the solid image portion may include uneven glossiness. To prevent such uneven glossiness of the image, an elastic layer with a thickness of 100 μm or more is desired.

Examples of materials for a pipe-shaped metal to be used for the hollow roller include iron or stainless steel. When a heat source is disposed inside the pressure roller 22, a heat insulation layer need be disposed on a surface of a substrate, or alternatively, a heat ray reflection surface need be provided by mirror finishing, to thereby prevent the substrate from being heated by the radiation heat from the heat source. In addition to the above-described halogen heater, an IH heater, a resistance heat generator, or a carbon heater can be used for the heat source.

Because the above fixing device 20 employs a structure to directly heat the low-thermal capacity heating member, a temperature of the fixing device 20 increases very quickly and a first print can be obtained quickly. However, from the view of the back curl of the recording sheet P, because fixation is performed before the heat roller is fully heated, the difference in the temperature of the front side and back side of the recording sheet P causes the back curl (that is, a curved shape of a solid line P' as illustrated in FIG. 2) to be greater.

A separator feeder device disposed at an outlet side of the recording sheet of the fixing device 20 separates the recording sheet P that has passed through the fixing nip portion N, in the vicinity of the fixing nip portion N, and guides it to the ejection direction toward the ejection tray.

The separator feeder device includes a belt-side separator member 201 disposed on the side of the fixing belt 21; and a pressure-side separator member 202 disposed on the side of the pressure roller 22. The belt-side separator member 201 includes a tip end 201*a* coming close to the fixing belt 21 downstream in a moving direction of the recording sheet P moving from the fixing nip portion. The pressure-side separator member 202 includes an oscillation end 202*a* coming close to the pressure roller 22.

The belt-side separator member 201 is disposed to peel off the recording sheet P that tends to adhere to the fixing belt 21, from the fixing belt 21. Accordingly, the belt-side separator member 201 is preferably formed of metal material to have a precision in positioning so that the recording sheet P adhering to the fixing belt 21 can be peeled off from the surface of the fixing belt 21.

The pressure-side separator member 202 is formed of a resin mold and includes a support rod 202A disposed on a part thereof. The support rod 202A is rotatably supported to a side of the apparatus body, and the pressure-side separator member 202 oscillates such that the oscillation end 202*a* disposed opposite the pressure roller 22 can be contacted to and separated from the pressure roller 22.

The pressure-side separator member 202 oscillates relative to the pressure roller 22, and oscillates greatly in a direction separating from the pressure roller 22 when a jammed recording sheet P is removed from the fixing nip portion N, to secure a large space for maintenance to the fixing nip portion N. With this structure, the recording sheet P can be removed with ease.

The back curl correction structure C, disposed downstream of the fixing device 20 in the feeding direction, includes a drive roller 204, a driven roller 203, a guide member 205, and a guide moving device D.

The drive roller 204 and the driven roller 203 are disposed downstream of the separator members 201 and 202. The drive roller 204 and the driven roller 203 press against each other to form an auxiliary nip portion AN. The auxiliary nip portion AN constructs a feeding path regulator to define the feeding direction of the recording sheet P upstream of the guide member 205 in the feeding direction.

The drive roller 204 is disposed on a side where the recording sheet P generates a back curl in the fixing nip portion, that is, on the side of the pressure roller 22, relative to the recording sheet feeding path to pass through the fixing device 20.

The driven roller 203 is disposed on the side where the recording sheet P is heated in the fixing nip portion, that is, on the side of the fixing belt 21, relative to the recording sheet feeding path passing through the fixing device 20. The drive roller 204 and the driven roller 203 construct an auxiliary nip portion and rotate to auxiliary guide the feeding of the recording sheet P. A distance between the fixing nip portion and the auxiliary nip portion is set shorter than a length of the recording sheet P.

A structure to prevent a jam from occurring will be described.

First, a diameter of the drive roller 204 is set greater than that of the driven roller 203. A feeding speed of the recording sheet in the auxiliary nip portion is set higher by a predetermined amount than that of the recording sheet in the fixing nip portion. A nip pressure in the auxiliary nip portion is set smaller by a predetermined amount than that in the fixing nip portion. With this structure, a jam of the recording sheet P does not occur in the portion between the fixing nip portion and the auxiliary nip portion.

Preferably, a surface of the roller of the drive roller 204 is formed of rubber and at least a surface of the roller of the driven roller 203 is harder than the surface of the roller of the drive roller 204 and has a releasability.

In the present embodiment, the drive roller 204 includes a metal core 204*a* (which corresponds to a roller shaft 204*a*); a solid rubber material 204*b*, having a higher wear coefficient, disposed on the surface of the metal core 204*a*, and obtains performance to feed the recording sheet. Exemplary materials for the solid rubber material 204*b* include silicon, EPDM, urethane, and fluorine rubber. The driven roller 203 is a hollow pipe-shaped metal tube covered by a thin layer of PFA, ETFA, or PEP 30 μm to 300 μm thick.

During fixation, water vapor is generated from the paper and condenses. The hollow pipe-shaped metal is used to prevent dew condensation from adhering to the driven roller, because the hollow metal pipe has a low thermal capacity, and is heated quickly by the heat from the fixing device.

A thin sleeve is disposed on the surface of the metal pipe to prevent a small amount of toner that has not melted during the fixation from adhering to the tube, and further, from accumulating thereon even though a certain amount of toner adhered. Specifically, the driven roller 203 feeds the recording sheet P while constantly contacting the surface on which the image is formed, of the recording sheet P as described heretofore.

The driven roller 203 is held to the body of the image forming apparatus by a spring via a holder, and the holder is pressed by the spring, so that the drive roller 204 and the driven roller 203 contact each other to form the auxiliary nip portion and auxiliary feed the recording sheet P.

The guide member 205 is so disposed to the fixing device as to coaxially rotate about the roller shaft 204*a* of the drive roller 204. The guide moving device D, which will be described later, drives the guide member 205 to move to a first position as illustrated in FIG. 2 or a second position as illustrated in FIG. 3. The first position is a forwarding position to contact the recording sheet P and the second position is a retracted position separating from the recording sheet P.

The guide member 205 is disposed downstream of the fixing nip portion N at the same side as the pressure roller 22 relative to the feeding direction of the recording sheet P, and, at the first position as illustrated in FIG. 2, guides the recording sheet P to bend the recording sheet P to a direction opposite that of the back curl generated in the fixing nip portion N.

When positioned at the first position as illustrated in FIG. 2, the guide member 205 slidably contacts a front side of the recording sheet P in the feeding direction passing through the auxiliary nip portion in the same side of the drive roller 204, so that the guide member 205 serves to bend the recording sheet P in a concave shape toward a side opposite the back curl of the recording sheet P.

Specifically, the guide member 205 when held at the first position, positions to disturb the path from the same side of the drive roller 204 relative to a direction of the recording sheet P passing through the auxiliary nip portion, which is a right angle to a line connecting each center of the pair of rollers.

Thus, the leading end of the recording sheet P contacts the guide member 205 at a contact angle θ as illustrated in FIG. 2. The recording sheet P then is pressed by the guide member 205 and auxiliary fed by the nip feed force between the drive roller 204 and the driven roller 203.

As a result, the guide member 205 finally feeds the recording sheet P applying a contact angle θ1 with the auxiliary nip portion set as a starting point, so that the recording sheet P bends to form a concave surface at a side opposite the back curl, and a back curl correction is thus performed. By providing such a feeding path, the back curl generated in the fixation of the recording sheet P is ameliorated while the recording sheet is passing through the guide member 205, and the recording sheet P is ejected to the sheet ejection tray 14.

However, because the guide member 205 actively contacts a back side of the recording sheet P at the first position, a feed resistance between the back side of the recording sheet P and the guide member 205 is large, and gives a stress to the sheet itself. In feeding the second side of the recording sheet P which is not cardboard in the duplex mode, because the first side on which the image is formed and the guide member 205 contact, image rubbing and gloss stripe tend to occur.

In particular, in feeding the second side, the first side image, which is a back side when the fixing device fixes the second surface image, is again heated when passing through the fixing nip portion. When the heated first side image is strongly slid by the guide member 205, toner tends to be peeled off and the glossiness changes.

Accordingly, the guide member 205 positions at the second position as illustrated in FIG. 3. When positioned at the second position, the guide member 205 does not contact the recording sheet P that is passing through the auxiliary nip portion, so as not to bend the recording sheet P.

The guide member 205 when positioned at the second position greatly retracts from the feeding direction (that is, a right angle relative to the line connecting each center of the pair of rollers) of the recording sheet P ejected from the auxiliary nip portion, and takes a position not to contact the recording sheet P actively. In this case, the back curl in feeding the sheet is not corrected, but because there is no stress to the sheet, no back side blur, abrasion, image rubbing, and gloss stripe occur.

In feeding the second side of the recording sheet P which is not cardboard in the duplex mode, the back curl does not occur differently from the fixation of the first image side, so that retracting of the guide member 205 to the second position gives a favorable effect.

In feeding the second side of the recording sheet P which is not cardboard in the duplex mode, the guide member 205 does not retract up to the second position, but is configured to reach the first position in at least one-side printing mode among one-side printing mode and duplex printing mode.

On the other hand, when the recording sheet P is cardboard having a high rigidity, such a recording sheet P has a higher contact resistance with the guide member 205 compared to the thin recording sheet P with a low rigidity when the guide member 205 positions at the first position. As a result, the thick sheet itself receives a greater stress, a contact trace tends to be generated on the back side of the sheet, and the guide member 205 itself tends to be abraded.

However, the back curl does not occur to the recording sheet P being cardboard with a high rigidity. Accordingly, when the recording sheet P is cardboard having a high rigidity, the guide member 205 is positioned at the second position as illustrated in FIG. 3 in both cases of feeding the first side in the one-side printing mode and the second side in the duplex printing mode.

As described above, by switching the guide member 205 between the first position and the second position, correction of the back curl and prevention of the image rubbing are achieved collaterally.

Next, the guide member 205 and the guide moving device D will be described referring to FIGS. 4 to 9.

Figure 4:
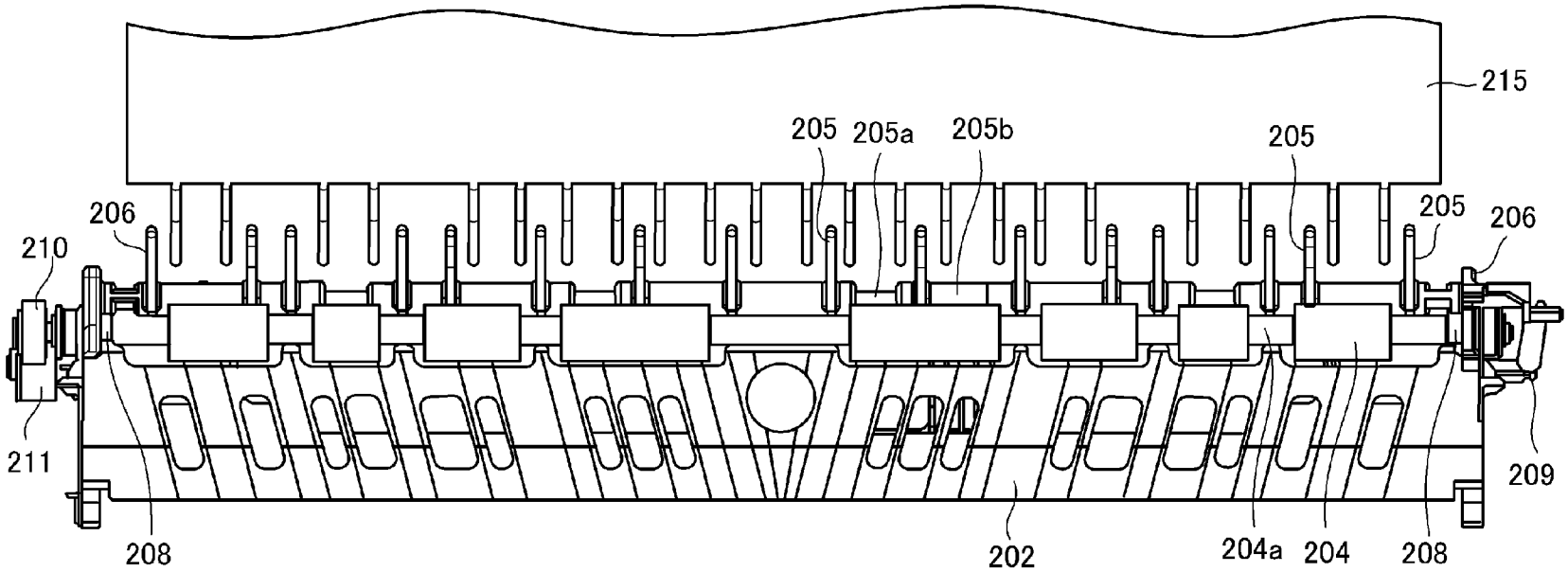
FIG. 4 illustrates a separator member of a pressure roller side, a driver roller, and a. guide member viewed from a direction indicated by an arrow IV in FIG. 3.

As illustrated in FIG. 4, the drive roller 204 includes a roller shaft 204*a* and a plurality of short cylindrical parts. The both ends of the roller shaft 204*a* are rotatably supported by the pressure-side separator member 202 via sliding bearings 208, and the plurality of short cylindrical parts formed of a rubber material is fixed on the roller shaft 204*a* spaced with predetermined intervals apart.

Figure 6:
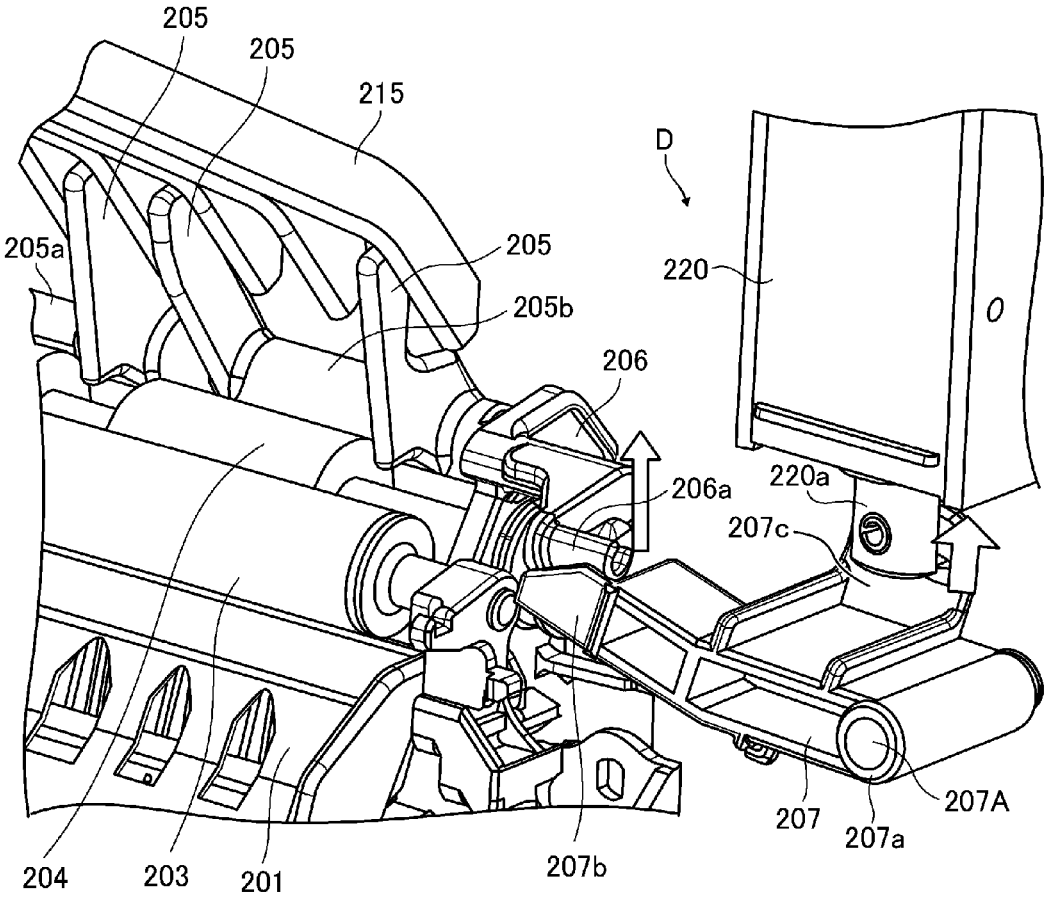
FIG. 6 is an enlarged perspective view of part of the fixing device when the guide member positions at a second position, viewed from the side of the feeding path according to one embodiment of the present invention.

Rotary drive force from the guide moving device D as illustrated in FIG. 6 is transmitted to a drive gear 210 secured at an end of the roller shaft 204*a* via an idler gear 211, so that the drive roller 204 rotates.

As illustrated in FIGS. 4 to 7, each of the guide member 205 is secured to a support shaft 205*a*, both ends of which are rotatably supported at an upper end of a pair of bracket arms 206.

The pair of bracket arms 206 rotatably engages on an outer diameter portion of the sliding bearings 208. The guide members 205 are disposed on a plurality of bosses 205*b* secured to engage on the support shaft 205*a*.

A base end of the guide member 205 is fixed to each of the bosses 205*b* and another extended end of the guide member 205 extends to cover the drive roller 204. The guide member 205 is configured to stop at a position where a stopper 206*b* of the bracket arm 206 contacts a portion of the pressure-side separator member 202. At this time, the guide member 205 positions at the first position to change the angle of the recording sheet P ejected from the auxiliary nip portion.

Figure 5:
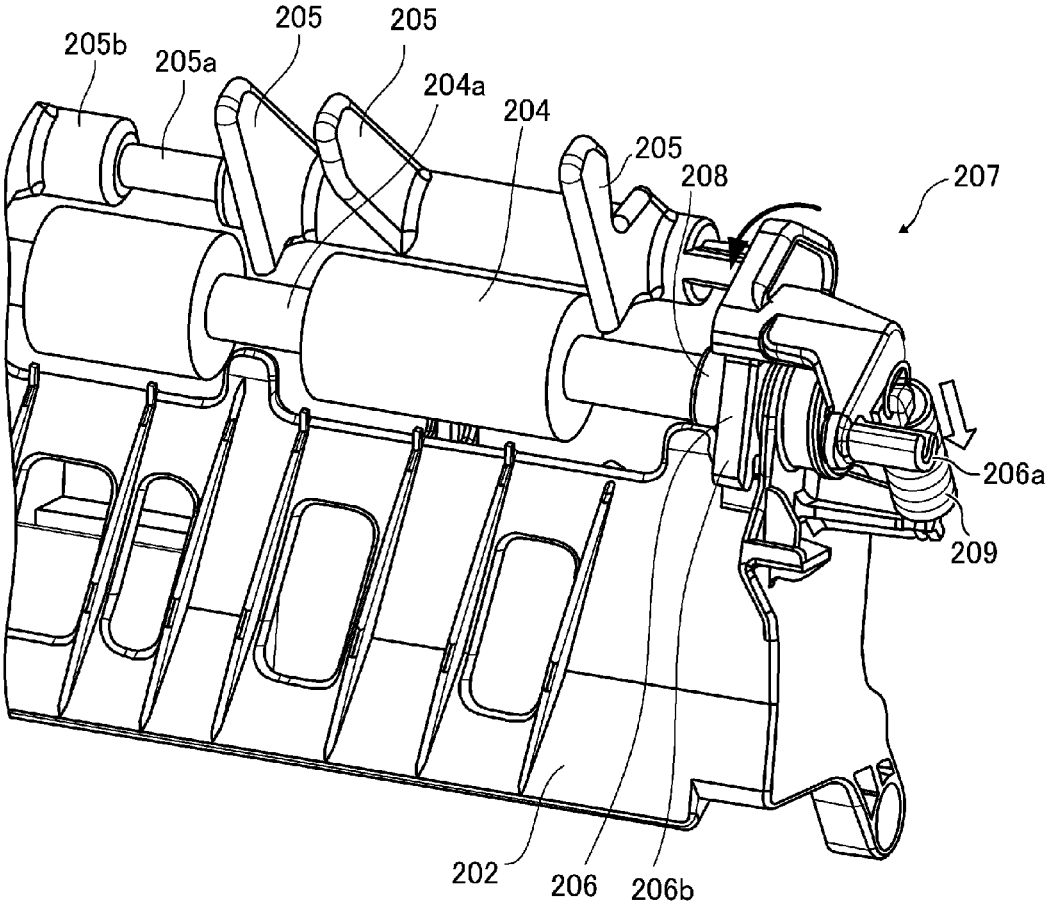
FIG. 5 is a perspective view of part of the fixing device when the guide member positions at a first position, viewed from a side of a feeding path according to one embodiment of the present invention.
Figure 7:
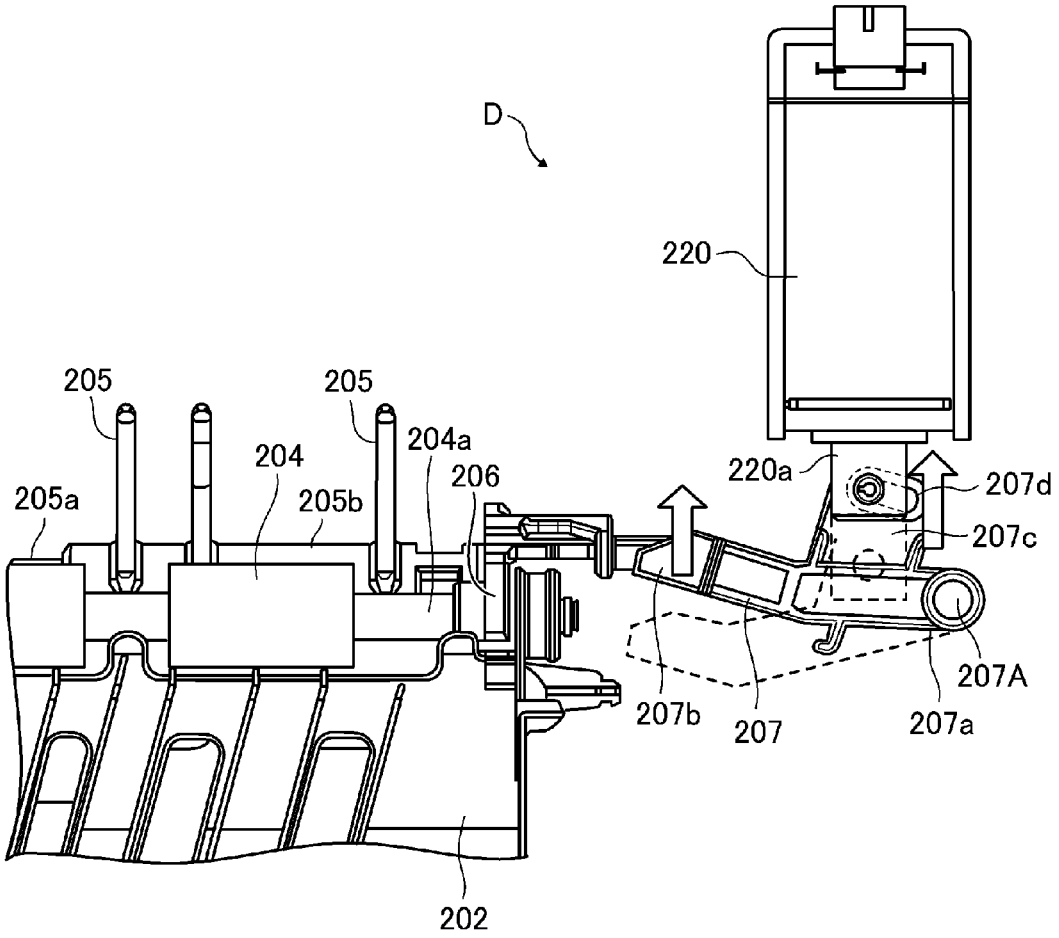
FIG. 7 illustrates part of the fixing device when a guide moving device operates and the guide member positions at the second position, viewed from the side of the feeding path according to one embodiment of the present invention.

As illustrated in FIGS. 5 to 7, the guide moving device D includes a solenoid 220 serving as a drive source, a link structure 207 to oscillate due to operation of the solenoid 220, and an extension spring 209. A body of the solenoid 220 is secured to the body of the image forming apparatus 1. The guide moving device D is driven based on control signals from a controller of the image forming apparatus.

One end of the extension spring 209 is engaged with a side of the pressure-side separator member 202 and another end thereof is engaged with an interim portion of the arm 206*a* of the bracket arm 206. A spring exerts a pulling force to rotate the bracket arm 206 to a direction such that the guide member 205 positions at the first position as illustrated in FIG. 2.

As illustrated in FIG. 7, the link structure 207 includes an end 207*a* in the horizontal direction. The end 207*a* is supported by a fixed pin shaft 207A. Another operation end 207*b* contacts to cover from a bottom side of a leading end of an arm 206*a* of the bracket arm 206. A long slot 207*d* is disposed on an upper end of an upper extension portion 207*c* that extends upward from an interim portion of the link structure 207 in the horizontal direction, and the long slot 207*d* joints an extension rod 220*a* of the solenoid 220 with a pin. As illustrated in FIG. 7, the extension rod 220*a* of the solenoid 220 extends (see a position indicated by a broken line), and as illustrated in FIG. 6, the operation end 207*b* of the link structure 207 is separated downward from the leading end of the arm 206*a* of the bracket arm 206.

Figure 8:
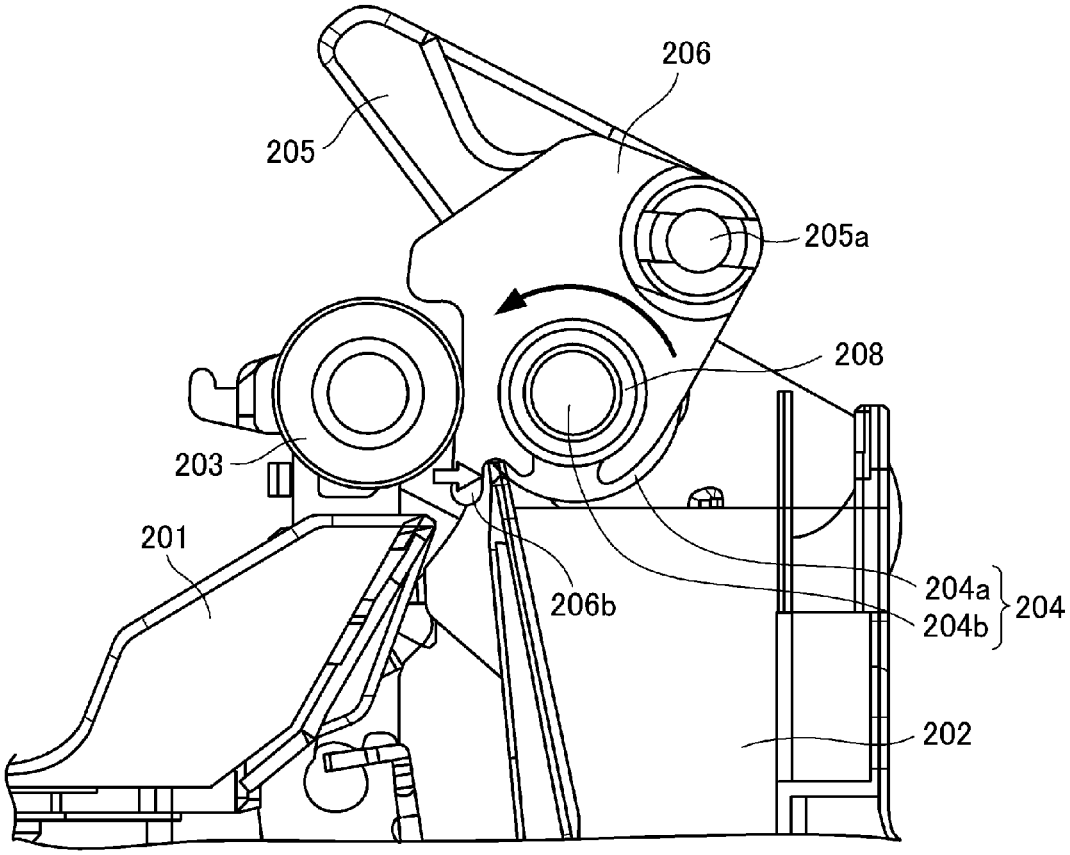
FIG. 8 is a front view of part of the fixing device when the guide member positions at the first position, viewed from the side of the feeding path according to one embodiment of the present invention.
Figure 9:
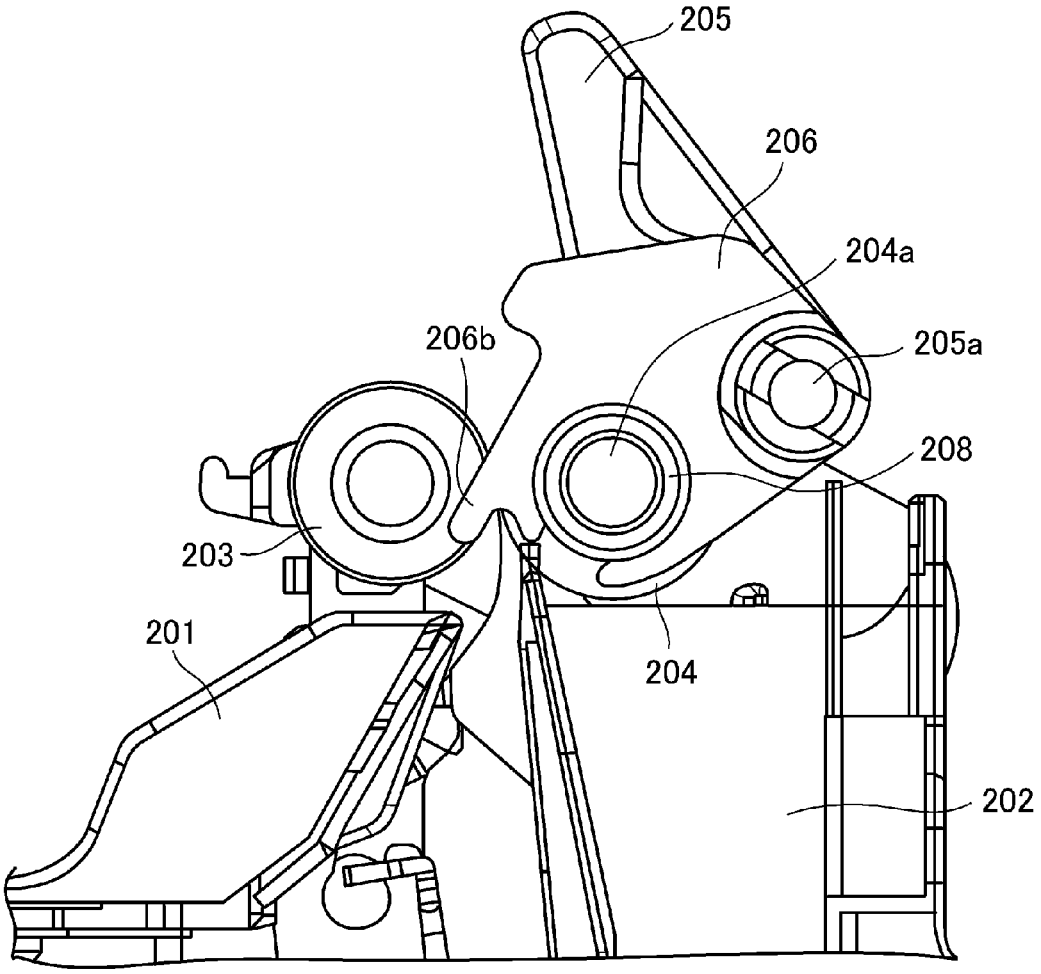
FIG. 9 is a front view of part of the fixing device when the guide member positions at the second position, viewed from the side of the feeding path according to one embodiment of the present invention.

From a state as illustrated in FIG. 6, when electric current is supplied to an internal coil of the solenoid 220 based on control signals of the controller, the extension rod 220*a* of the solenoid 220 retracts. With this, the link structure 207 rotates against the extension force of the extension spring 209, and the operation end 207*b* lifts up the leading end of the arm 206*a*. of the bracket arm 206 (as illustrated in FIG. 7). Accordingly, the guide member 205 positions at the second position as illustrated in FIGS. 3 and 9, from the first position as illustrated in FIGS. 2 and 8.

On the other hand, from a state as illustrated in FIG. 7, when the electric current is not supplied to the internal coil of the solenoid 220 based on control signals of the controller, the bracket arm 206 rotates due to the extension force of the extension spring 209, and the guide member 205 returns to the first position as illustrated in FIG. 2, and the extension rod 220*a* of the solenoid 220 retracts due to the extension force of the extension spring 209, to thereby come to a state as illustrated in FIGS. 5 and 6.

As configured as above, a gap between the drive roller 204 and the guide member 205 is minimized such that a cumulative dimensional tolerance of parts is minimized, i.e., with allowances of the radial distance from the shaft center of each part alone. As a result, the gap between the drive roller 204 and the guide member 205 is kept constant with high precision, and the guide member 205 is movable.

Figure 10A:
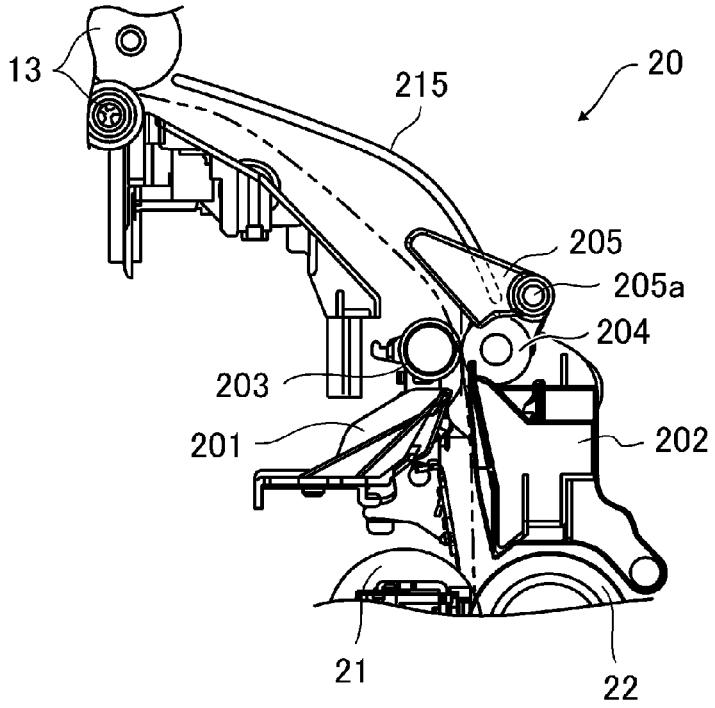
FIGS. 10A and 10B illustrate a plurality of sheet feeding paths, each of which is formed in combination of a position of the branching member and the guide member according to the embodiment of the present invention.

FIG. 10A illustrates a feeding path of the thin recording sheet in one-side printing mode. The guide member 205 is disposed at the first position and contacts a back side of the recording sheet while the recording sheet is passing through the auxiliary nip portion so as to bend the recording sheet in the concave curved surface in the direction opposite the back curl, to thereby guide the recording sheet to the sheet ejection rollers 13.

Figure 10B:
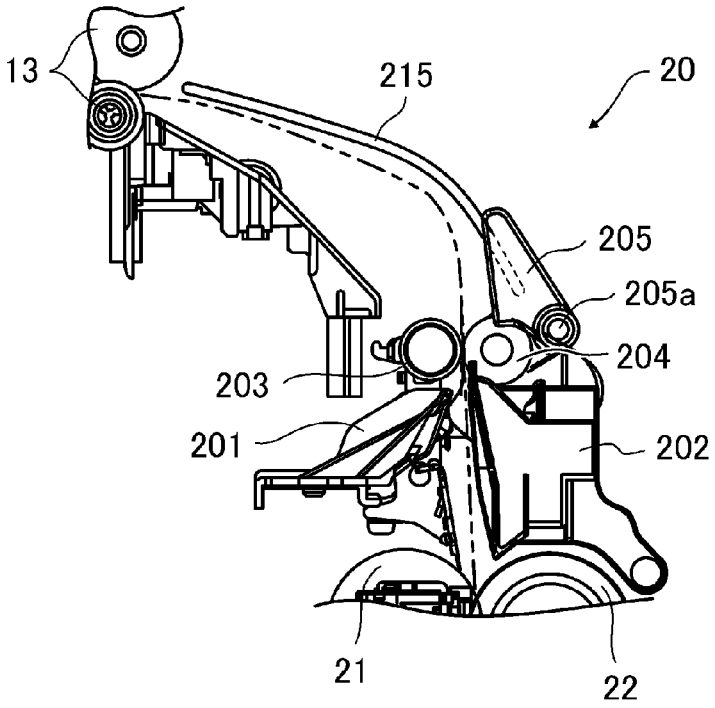

FIG. 10B illustrates a feeding path of the recording sheet being cardboard in one-side printing mode. The guide member 205 does not contact a back side of the recording sheet with no back curl while the recording sheet is passing through the auxiliary nip portion, a sheet ejection path forming member 215 softly bends the recording sheet to guide the recording sheet to the sheet ejection rollers 13.

As illustrated in FIG. 4, the guide member 205 includes a plurality of ribs along the longitudinal direction and the rib-shaped sheet ejection path forming member 215 enters between adjacent ribs of the guide member 205.

Figure 11:
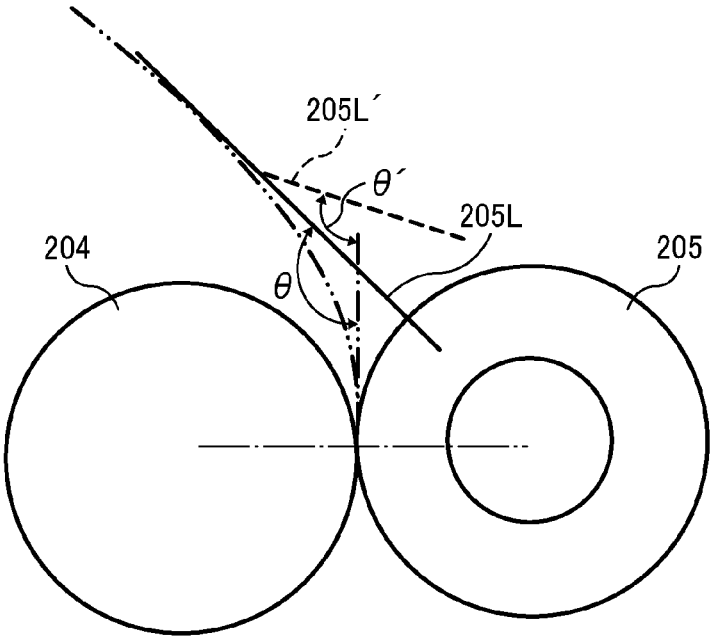
FIG. 11 is a view to illustrate an effect of an intersection angle between a recording sheet feeding direction and the guide member in an auxiliary nip portion exerted to the back curl correction, according to one embodiment of the present invention.

FIG. 11 illustrates a case in which the rotary center of the guide member 205 is disposed in accordance with the rotary center of the drive roller 204 (that is, the position indicated by a solid line 205L in the figure), and a comparable case in which the rotary center of the guide member 205 is separated from the rotary center of the drive roller 204 by a certain gap (that is, the position indicated by a dotted line 205L' in the figure).

As viewed from FIG. 11, the curl correction effect when the guide member 205 positions in the solid line position and when the guide member 205 positions in the dotted line position are the same.

Specifically, the recording sheet that passes through the auxiliary nip portion is ejected to a direction perpendicular to the line connecting each rotary center of the drive roller 204 and the driven roller 203. As a result, a contact angle θ' between the leading end of the sheet in the vicinity of the auxiliary nip portion and the guide member 205 when the guide member 205 positions at a dotted-line position is smaller than the contact angle θ between the leading end of the sheet in the vicinity of the auxiliary nip portion and the guide member 205 when the guide member 205 positions at the solid-line position.

If this contact angel decreases, the sheet is fed with its leading end bent and looped, to thereby increasing a risk of paper jamming. In contrast, when the extension line of the surface of the guide member 205 that positions and contacts the recording sheet is shifted from the rotary center of the drive roller 204 and the contact angle becomes larger than the contact angle θ, the curl correction effect of the guide member 205 to bend the sheet tends to decrease.

Then, in the present embodiment, the rotary center of the guide member 205 is adjusted according to the rotary center of the drive roller 204 to increase the contact angle, and the extension line of the surface of the guide member 205 that contacts the recording sheet, passes through the rotary center of the drive roller 204.

To obtain the curl correction effect, the leading end of the guide member 205 needs to be closer to the auxiliary nip portion. Accordingly, the plurality of rubber portions of the drive roller 204 is disposed with a spacing and each guide member 205 enters between the rubber portions.

The image forming apparatus according to the present embodiment, includes the drive roller 204 and the driven roller 203 disposed immediately downstream of the fixing device 20, and the guide member 205 disposed immediately downstream of the auxiliary nip portion. The guide moving device D switches a position of the guide member 205 between the first position and the second position. With this structure, the feeding path is configured such that the back curl of the recording sheet P due to the fixing device 20 is corrected and bent by the guide member 205 to a direction opposite that of the back curl, and the first position with a bending correction and the second position without bending correction are made switchable. Because the guide member 205 is switchable between the first position and the second position, the back curl correction can be performed only when the correction is necessary.

For example, when the recording sheet P is a thick sheet, no back curl occurs in the fixing device 20. As a result, when the guide member 205 positions at the first position constantly, the thick sheet may include a face curl clue to the guide member 205 on the contrary. In addition, because the contacting force between the guide member 205 and the recording sheet is strong, the recording sheet suffers a damage such as scratches and the guide member 205 is abraded. Further, due to a high rigidity of the sheet, a leading end of the sheet that contacts the guide member 205 upon going out from the auxiliary nip portion between the drive roller 204 and the driven roller 203, bends, so that the guide member 205 need not be disposed at the first position to correct the back curl.

The image forming apparatus according to the present embodiment includes a driving unit to switch the position of the guide member 205 from the above viewpoint, and causes the guide member 205 to be switchably positioned at either the first position or the second position depending on the conditions of the recording sheet P. Thus, the image forming apparatus achieves the reduction of the back curl due to fixation, and stable feeding of the sheet, and reduces damage to the recording sheet P.

According to the present embodiment, the nip forming member is not an arc shape and includes at least one straight surface, and the feeding path of the sheet is configured to correct the bent surface due to fixation by bending the sheet to a direction opposite the bent surface. Thus, the image forming apparatus achieves an optimal feeding of the envelope and a back curl reduction after fixation collaterally.

The fixing device according to the present embodiment includes a regulating member disposed immediately before the guide member 205, to regulate the feeding path, so that the bending of the sheet by the guide member 205 is not diminished and the back curl after fixation can be reduced further effectively.

The fixing device according to the present embodiment includes the drive roller 204 disposed at a back side of the image and the driven roller 203 disposed at a front side of the image, both of which are disposed immediately before the guide member 205 and form an auxiliary nip portion or a correction nip portion. With this correction nip portion, the bending of the recording sheet at a portion between the fixing nip portion and the back curl correction portion can be prevented, and the recording sheet can be auxiliary fed after passing through the fixing nip portion. In addition, the correction nip portion is disposed upstream and near the back curl correction position by the guide member 205 and holds the recording sheet. Accordingly, bending of the recording sheet is effectively done by the guide member 205, thereby reducing the back curl after fixation.

The fixing device according to the present embodiment is configured such that the drive roller 204 includes a diameter larger than that of the driven roller 203. As a result, the leading end of the recording sheet P with a back curl generated in the fixing nip portion first contacts the drive roller 204 that stably rotates. As a result, the leading end of the recording sheet P is led to the auxiliary nip portion between the driven roller 203 and the drive roller 204 stably, to thereby prevent a paper jam from occurring, and the sheet is stably conveyed.

The image forming apparatus according to the present invention is configured such that the feeding speed of the recording sheet in the auxiliary nip portion is set slightly faster than that of the recording sheet in the fixing nip portion. As a result, the sheet is prevented from loosening, bending in the middle thereof, and jamming between the fixing nip portion and the auxiliary nip portion. Further, contact of the sheet to the separator members 201 and 202 between the fixing nip portion and the auxiliary nip portion can be prevented, so that an abnormality does not occur to the fixed image.

The image forming apparatus according to the present embodiment includes a fixing device to fix the toner image transferred to the recording sheet with heat and pressure, thereby providing an image forming apparatus with optimal feeding of the envelope and capable of reducing a curl after fixation.

As described heretofore, according to the present invention, an optimal feeding of the envelope and reduction of a back curl after fixation can be collaterally achieved, and thus the present invention is generally useful for the fixing device and image forming apparatus employing electrophotography such as a copier, facsimile machine, and a printer.

Additional modifications and variations of the present invention are possible in light of the above teachings. it is therefore to be understood that, within the scope of the appended claims, the invention may be practiced other than as specifically described herein.

What is claimed is:

1. A fixing device comprising:

a flexible endless fixing member;

a heater to heat the fixing member;

a nip forming member to contact the fixing member; and a pressure member, disposed opposite the nip forming member via the fixing member, to press against the fixing member to form a fixing nip portion together with the nip forming member and rotationally drive the fixing member, wherein the fixing device applies heat and pressure to fix an image transferred to a recording sheet when the recording sheet passes through the fixing nip portion, and a guide member, disposed downstream of the fixing nip portion in a feeding direction of the recording sheet on the same side as the pressure member relative to a feeding path of the recording sheet, to guide the recording sheet to bend in a direction opposite a direction of a back curl of the recording sheet generated in the fixing nip portion, a feeding path regulator disposed immediately upstream of the guide member in the feeding direction, the feeding path regulator including a drive roller, the guide member having an axis of rotation common to an axis of rotation of the drive roller.

2. The fixing device according to claim 1, wherein the feeding path regulator is configured to regulate the feeding path of the recording sheet.

3. The fixing device according to claim 2, wherein the feeding path regulator is an auxiliary nip portion including the drive roller disposed on the same side as the pressure member and a driven roller disposed opposite the drive roller relative to the feeding path of the recording sheet.

4. The fixing device according to claim 3, wherein the drive roller has a diameter larger than a diameter of the driven roller.

5. The fixing device according to claim 4, wherein a feeding speed of the recording sheet in the auxiliary nip portion is greater than a feeding speed in the fixing nip portion.

6. An image forming apparatus comprising the fixing device according to claim 1, to fix an image transferred to the recording sheet onto the recording sheet with heat and pressure.

7. The fixing device according to claim 1, wherein the guide member comprises a contact surface extending perpendicularly from the axis of rotation of the drive roller.

8. The fixing device according to claim 7, wherein the contact surface is circumferentially fixed relative to the drive roller.

* * * * *